United States Patent [19]

Mader et al.

[11] Patent Number: 4,969,231

[45] Date of Patent: Nov. 13, 1990

[54] HAND TOOL HANDLE HAVING END CAP WITH INDICIA

[75] Inventors: William G. Mader, York; James A. Van Lenten, Lancaster, both of Pa.; Philip A. Desmarais, Gastonia, N.C.

[73] Assignee: EASCO Hand Tools, Inc., Hunt Valley, Md.

[21] Appl. No.: 352,936

[22] Filed: May 17, 1989

[51] Int. Cl.[5] ..... B25G 1/00

[52] U.S. Cl. ..... 16/141 R; 81/177.1

[58] Field of Search ..... 16/111 R, 116 R, DIG. 12, 16/110 R; 81/25, 177.1, 492

[56] References Cited

U.S. PATENT DOCUMENTS

| | | | |
|---|---|---|---|
| 125,098 | 2/1841 | Abramson | 34/228 |
| 428,893 | 5/1890 | Cook | 81/492 |
| 1,161,270 | 11/1915 | Vance | 16/116 R |
| 1,694,559 | 12/1928 | Osgood | 81/492 |
| 2,123,393 | 7/1938 | Windsor | 279/95 |
| 2,175,481 | 10/1939 | Padulo | 40/618 |
| 3,189,069 | 6/1925 | Stowell | 16/116 R |
| 3,343,577 | 9/1967 | Wagner | 16/DIG. 12 |
| 3,549,189 | 12/1970 | Alosi | 273/81 R |
| 4,170,909 | 10/1979 | Wagner | 81/177.7 |
| 4,290,465 | 9/1981 | Foe et al. | 16/111 R |
| 4,381,579 | 5/1983 | Rumpp | 16/111 R |
| 4,452,289 | 6/1984 | Smith | 81/177.1 |
| 4,830,239 | 5/1989 | Tackles et al. | 156/73.1 |
| 4,836,059 | 6/1989 | Arnold | 81/DIG. 5 |

OTHER PUBLICATIONS

"Jensen" Fall Catalog 1977. Jenson Tools/Alloys, Tempe, AZ, p. 104, color coded Hollow-Shaft Nutdrivers.

*Primary Examiner*—Richard K. Seidel
*Assistant Examiner*—James Miner
*Attorney, Agent, or Firm*—Leonard Bloom

[57] ABSTRACT

A handle for a hand tool having a tool portion to which the handle is secured rearwardly thereof. The handle has a substantially polygonally shaped cross-section to prevent rolling of the tool. An elastomeric sleeve having ribs thereon is disposed over the handle to facilitate gripping thereof even in greasy and oily conditions. A plurality of pockets are formed in the rearward portion of the handle opposite to the tool portion. An end cap having a plurality of complementary studs is disposed over and secured to the rearward portion of the handle so that each stud is received in and secured in a respective pocket. The end cap is color-coded and/or otherwise provided with indicia means to facilitate user recognition and selection thereof. In another embodiment, the end cap is integral with handle portion.

30 Claims, 5 Drawing Sheets

HAND TOOL HANDLE HAVING END CAP WITH INDICIA

FIELD OF THE INVENTION

The present invention relates to hand tools and, in particular, to a handle for a hand tool that has an end cap with an indicia thereon which facilitates the quick and easy recognition and selection of the desired hand tool.

BACKGROUND OF THE INVENTION

Hand tools, such as nut drivers and screwdrivers, often come in sets which require the user thereof to identify and choose from those available the particular tool and/or size desired to be employed. Such hand tools include a tool portion, often having a shaft extending rearwardly therefrom, and a handle portion that is secured to the tool portion (or to the shaft thereof) rearwardly thereof. The precise nature of the tool portion can vary, for example, it may be a nut driver or a screwdriver. Additionally, the precise sizes of the tool portions may also vary, ranging in size from, for example 1/16" to ¾" in increments of a sixteenth of an inch.

Normally, sets of such hand tools are comprised of several of such tools, each of which is stamped with the size of its tool portion and/or other data or indicia. These indicias are often difficult to view, especially when the tool being utilized in dark or cramped places, such as in a basement (for example, behind a furnace) or beneath a motor vehicle. The individual tools in the kits may easily become mixed up, a problem which is compounded when sets having both English and Metric sizes are involved.

Additionally, use of such tools can prove problematic due to the shape and composition of the handles thereof. Often such tools are utilized in less than clean conditions, such that oil, grease, etc., can get on the handles thereof. In such conditions, these greases, oils, etc., make gripping and utilization of the handle (and the tool thereof) difficult.

Finally, use of such tools can prove problematic in that the shape of the handles are often either round or substantially cylindrical in cross-section. Thus, when used on surfaces which are not level, such hand tools are prone to rolling, i.e. rolling away from the user. This can be especially problematic where the retrieval of the tool constantly requires exiting from a working position (such as under a car) or when the work area is dark, thereby complicating location of the tool or when the work areas is full of places where the tool may roll (such as under an appliance) which may make retrieval thereof difficult or impossible to achieve.

Despite several proposals to solve one or two of the above problems, no handle (or hand tool) of which I am aware attempts to, or is able to, solve all three of the above-mentioned problems simultaneously, so as to provide a hand tool which is readily and easily identifiable by its indicia means, which can be utilized in conditions where oil and greases are present and which does not roll away even when placed on a nonlevel surface.

SUMMARY OF THE INVENTION

Accordingly, it is an object of the present invention to provide a handle for a hand tool that can be utilized in conditions where oil and grease are present, which is shaped so as not to move or roll away, even when placed on a nonlevel surface and which has an indicia thereon which readily facilitates user recognition and selection of the hand tool desired.

Accordingly, it is a further object of the present invention to alleviate the disadvantages of the prior art by providing an end cap on the rearward portion of the handle that is color-coded, thereby facilitating user recognition and selection of the desired hard tool.

It is another object of the present invention to provide a handle for a hand tool that includes an end cap which has easily discernable size indicia and/or other pertinent information printed thereon.

It is still another object of the present invention to provide a handle for a hand tool that combines the advantages of such an end cap with both a polygonally shaped handle that prevents the rolling thereof and an elastomeric sleeve which permits the tool to be easily gripped and utilized even in the presence of grease and oil.

It is yet another object of the present invention to provide such a handle for a hand tool which may be manufactured easily and economically and which facilitates the merchandising and promotion of entire tool kits or sets equipped therewith.

It is still yet another object of the present invention to provide a method to easily and economically manufacture such a handle combining all of the above features for a hand tool.

In accordance with the teachings of the present invention there is disclosed, in combination with a hand tool having a forward tool portion, a rearward handle portion. This handle portion is substantially polygonally shaped in cross-section, so that it will not roll, even when positioned on a nonlevel surface. An elastomeric sleeve that is substantially polygonally shaped in cross-section, so as to be complemental to the handle is also provided. This sleeve is disposed over the handle, so as to permit improved gripping of the handle and use of the tool, even in the presence of greases and oils. An end cap including an indicia means is provided, so that convenient and easy user recognition and selection of a particular tool may be affected. Means is provided for securing this end cap to the handle portion opposite to the forward tool portion.

In accordance with the teachings of the present invention there is disclosed, in combination with a hand tool having a tool portion, a handle portion. This handle portion is substantially triangular in cross-section and has a plurality of pockets formed therein. An elastomeric sleeve is disposed over the handle portion. Like the handle portion, this sleeve is substantially triangular in cross-section. An end cap, including an indicia means and a plurality of locating studs is provided. When disposed on the handle portion, each stud is received in a respective pocket. Finally, means is provided for securing the studs in the respective pockets, whereby the end cap is secured to the handle portion, substantially opposite the tool portion.

Also in further accordance with the teachings of the present invention, there is disclosed a hand tool having a forward tool portion and a rearward handle portion. The handle portion is substantially triangular in cross-section and has three triangularly spaced pockets formed therein. An end cap, including indicia means and three circumferentially spaced locating studs are disposed on the handle portion. In this manner, when disposed on the handle portion, each stud is received in a respective pocket. Means is provided for securing the studs in the pockets whereby the end cap is secured to the handle portion substantially opposite the tool portion.

In still further accordance with the teachings of the present invention, there is disclosed in combination with a hand tool having a forward tool portion, a rearward handle portion. A plurality of pockets are formed in the handle portion substantially opposite the tool portion. An end cap, including an indicia means, is disposed on the handle portion substantially over the pockets. The end cap has a plurality of studs formed thereon, such that when disposed on the handle portion, each stud is received in a respective pocket. Finally, means is provided for bonding the studs to the handle portion in the respective pockets, whereby the end cap is secured to the handle portion substantially opposite the tool portion.

In still yet further accordance with the teachings of the present invention, there is disclosed in combination with a hand tool having a forward tool portion, a rearward handle portion that is disposed on a common longitudinal axis. The handle portion is substantially geometrically shaped in cross-section. A plurality of pockets are formed as blind ended bores in the handle portion substantially opposite the tool portion. Each of said pockets is equidistantly spaced from the longitudinal axis. Each of said pockets if further equidistantly spaced from one another. An end cap, including an indicia means, is disposed on the handle portion substantially over the pockets. The end cap has a plurality of spaced studs formed thereon, such that when disposed on the handle portion each stud is received in a respective pocket. Finally, means is provided for bonding the studs to the handle portion in the respective pockets, whereby the end cap is secured to the handle portion substantially opposite the tool portion.

In another aspect of the present invention, there is disclosed a method for forming a handle portion for a hand tool having a tool portion. This method includes forming a rearward handle tool portion onto the tool portion. A plurality of pockets are formed in the handle portion substantially opposite the tool portion. An end cap, including an indicia means and a plurality of studs is formed. The end cap is disposed on the handle portion opposite the tool portion, such that the end cap is substantially received over the pockets with each stud being received in a respective pocket. Finally, the studs are bonded to the handle portion in the respective pockets, such that the end cap is secured to the handle portion substantially opposite to the tool portion.

In further accordance with the teachings of the present invention, a method is disclosed for forming a rearward handle portion for a hand tool having a tool portion. This method includes forming a substantially polygonally shaped rearward handle portion. The rearward handle portion is disposed onto the tool portion along a common longitudinal axis. A plurality of pockets are formed in the handle portion substantially opposite the tool portion, such that each of said pockets is substantially equidistantly spaced from the longitudinal axis and further such that each of said pockets are further equidistantly spaced from one another. An end cap is formed so as to include an indicia means and a plurality of spaced studs. The end cap is disposed on the handle portion opposite the tool portion, such that the end cap is substantially received over the pockets with each stud being received in a respective pocket. Finally, the studs are bonded to the handle portion in the respective pockets, such that the end cap is secured to the handle portion substantially opposite the tool portion.

These and other objects of the present invention will become apparent from a reading of the following specification, taken in conjunction with the enclosed drawings.

BRIEF DESCRIPTION OF THE DRAWINGS

FIG. 10 illustrates the disposition of the handle portion relative to the shank rearwardly of the tool portion.

FIG. 11 illustrates the orientation of the elastomeric sleeve relative to the handle portion.

FIG. 12 illustrates the disposition of the elastomeric sleeve on the rearward portion of the handle and the orientation and disposition of the end cap on the rearward portion of the handle.

DESCRIPTION OF THE PREFERRED EMBODIMENTS

Figure 1:
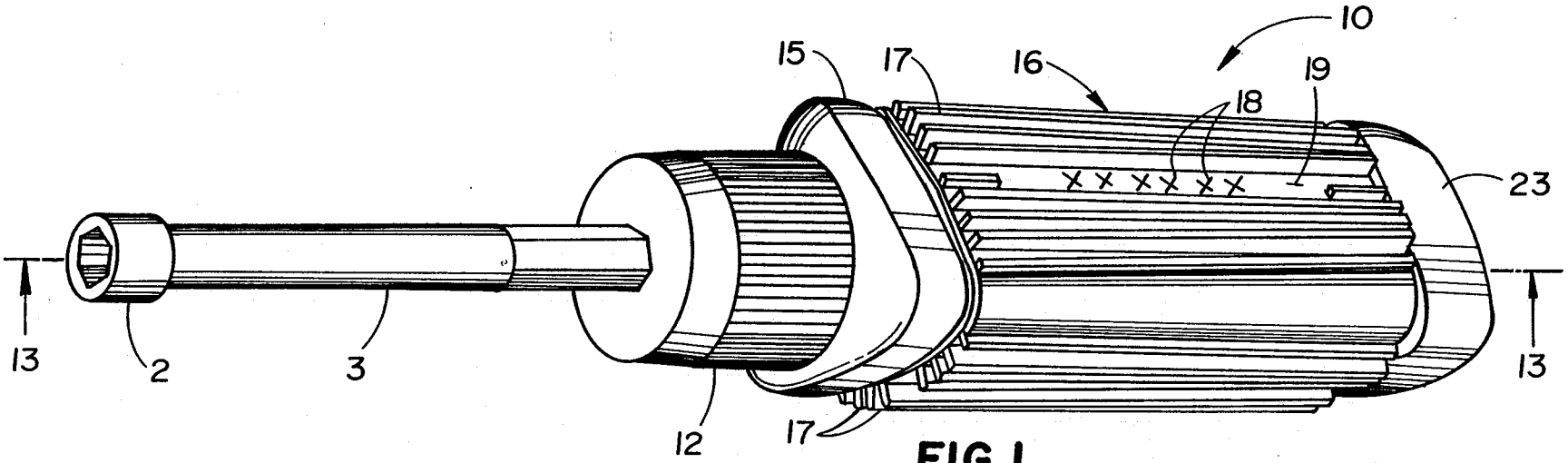
FIG. 1 is a perspective view of a preferred embodiment of a typical hand tool having the handle of the present invention.
Figure 4:
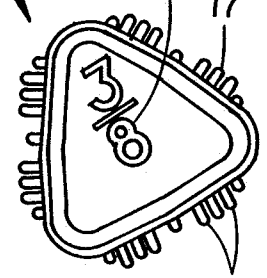
FIG. 4 is an end view thereof taken along lines 4—4 of FIG. 3 and looking at the end cap of the handle of the present invention.
Figure 3:
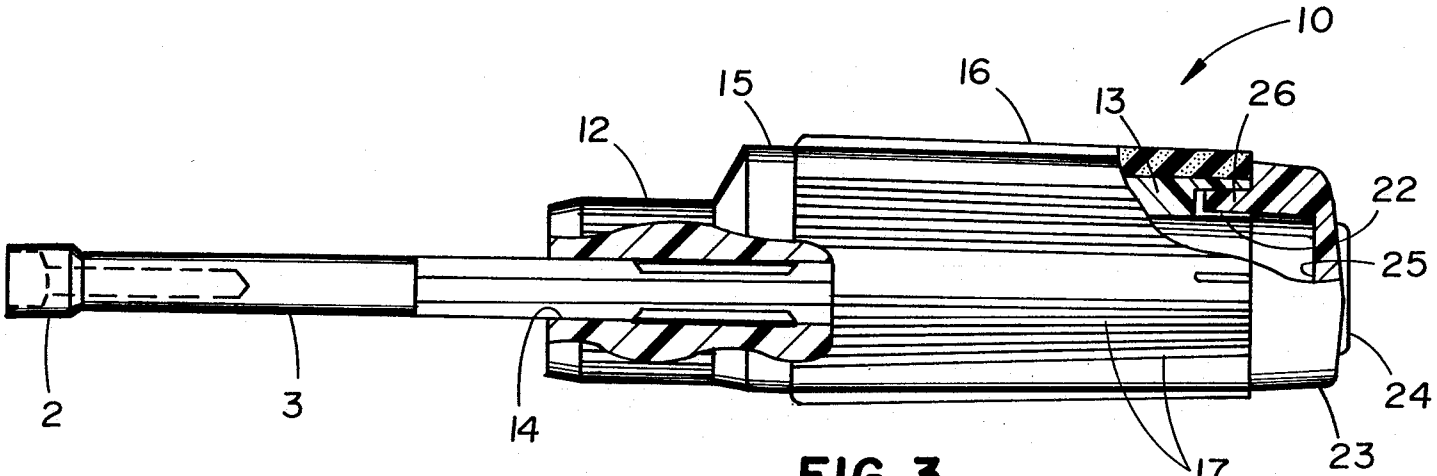
FIG. 3 is a side elevation view of the hand tool having the handle of FIG. 1 with portions thereof broken away for the sake of clarity.
Figure 2:
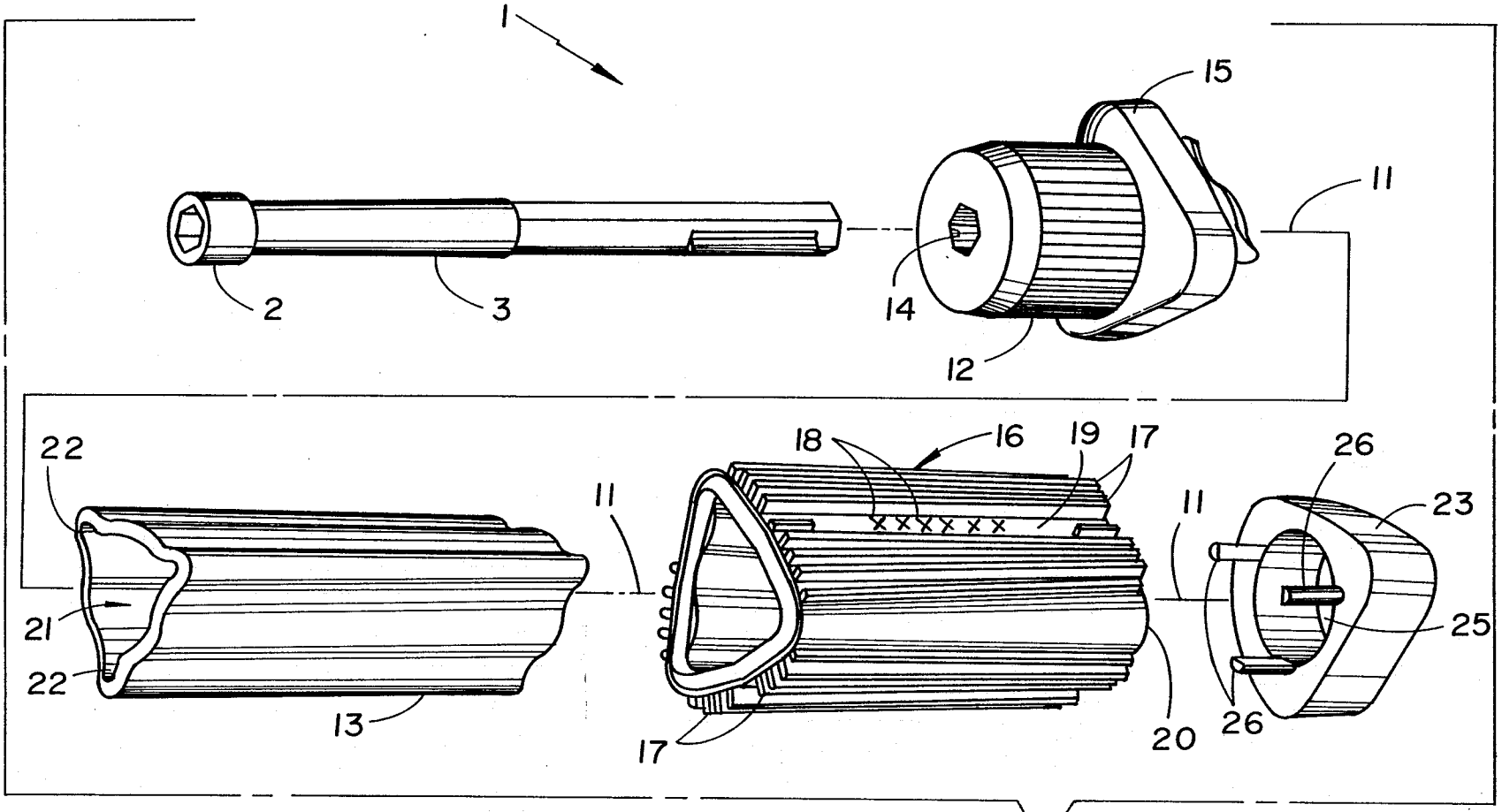
FIG. 2 is an exploded perspective view of the hand tool having the handle of the present invention.

With reference now to the FIGS. 1–6, a typical hand tool 1 has a tool portion 2 including a shank (shaft) 3 that is integral with the tool portion 2 and which extends rearwardly therefrom.

The handle 10 of the present invention may be formed so as to be integral with the shank 3 at an end thereof being opposite from the tool portion 2 and rearwardly thereof.

Preferably, the tool portion 2, shank 3 and the handle 10 are all disposed (positioned) on a common longitudinal axis 11.

Figure 9:
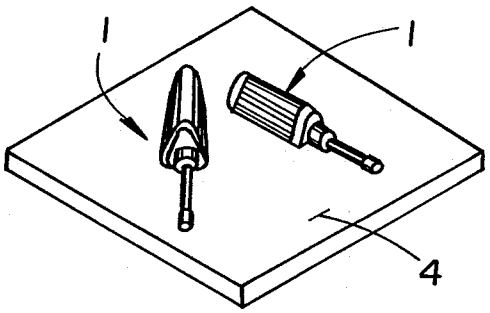
FIG. 9 illustrates how a hand tool having the handle of the present invention is precluded from rolling when placed on a surface.

To prevent the tool 1 from rolling when placed on a surface 4 (and especially an uneven or nonlevel surface) such as a table or floor, the handle 10 of the present invention is formed having a substantially polygonal shape in cross-section. Preferably, this handle 10 is substantially triangular shaped in cross-section. Such a shape provides the least amount of sides and, consequently, the least opportunity to roll when placed on a surface 4, thereby permitting several different hand tools 1 of this type to be utilized at the same time without the fear of any of the tools rolling away to where they might become lost or difficult to retrieve (see FIG. 9).

If desired, this handle 10 may be fluted, ribbed, knurled or otherwise formed, so as to provide for improved gripping thereof.

The handle 10 includes a forward portion 12 (comprising a nose piece) and a rearward portion 13 (comprising a hollow handle body) as shown in the drawings. The forward portion 12 and rearward portion 13 ar thereby located at opposite ends of the handle 10. The shank 3 is joined to, or otherwise integral with the forward portion 12 of the handle 10. Such joining can be effected by any suitable means. However, it is contemplated herein that such joining will be achieved by a mating arrangement between a bore 14 formed in the forward portion 12 (along the longitudinal axis 11) and the rearward end of the shank 3. The bore 14 and the rearward end of the shank 3 are complementary shaped such that the shank 3 is received in the bore 14 and is keyed thereto, so as to preclude axial separation therebetween. If desired, the shank 3 may be permanently retained in the bore 14 by use of an appropriate adhesive, such as glue.

A portion of the body of the handle 10 between the forward portion 12 and the rearward portion 13 is diametrically reduced (or turned down) to form an annular shoulder 15 therebetween.

Carried on the reduced rearward portion 13 of the handle 10 is a sleeve (an elastomeric sleeve) 16 which may abut (or seat) against the annular shoulder 15.

Preferably, the sleeve 16 is integrally molded from a suitable plastic, rubber or other elastic material and, if desired, may be shaped somewhat like an elastic "bicycle" type hand grip.

The gripping sleeve 16 is preferably elastic and is slightly stretched in order to be slipped over and placed on the handle 10. After being put in position, the sleeve 16 may be released so that it can return to its original size and grip the handle 10 by means of this elasticity. Such elasticity helps secure and maintain the sleeve 16 in position on the handle 10 and aids in precluding an axial separation therebetween. If desired, a suitable adhesive may be employed to further secure the sleeve 16 on the handle 10.

Preferably, the outer diameter of the elastomeric sleeve 16 is fluted, spined, knurled, ribbed or otherwise similarly formed so as to facilitate manual gripping thereof during use of the tool 1. These ribs 17 also aid in tending to prevent the tool 1 from rolling when placed on a surface 4.

If desired, suitable indicia and/or information (generally indicated as at 18) may be disposed in suitable recesses 19 defined between ribs 17 or various ribbed portions of the sleeve 16. This indicia 18 and/or information may be molded within the sleeve 16 and may be raised or projected. Alternatively, this indicia 18 and/or information may be molded clear through the sleeve 16, so that the underlying handle 10 is visible. In this event, the handle 10 itself may be color coded to aid in reading of the indicia 18. Further, it is noted that the sleeve 16 itself may also be color coded.

Figure 5:
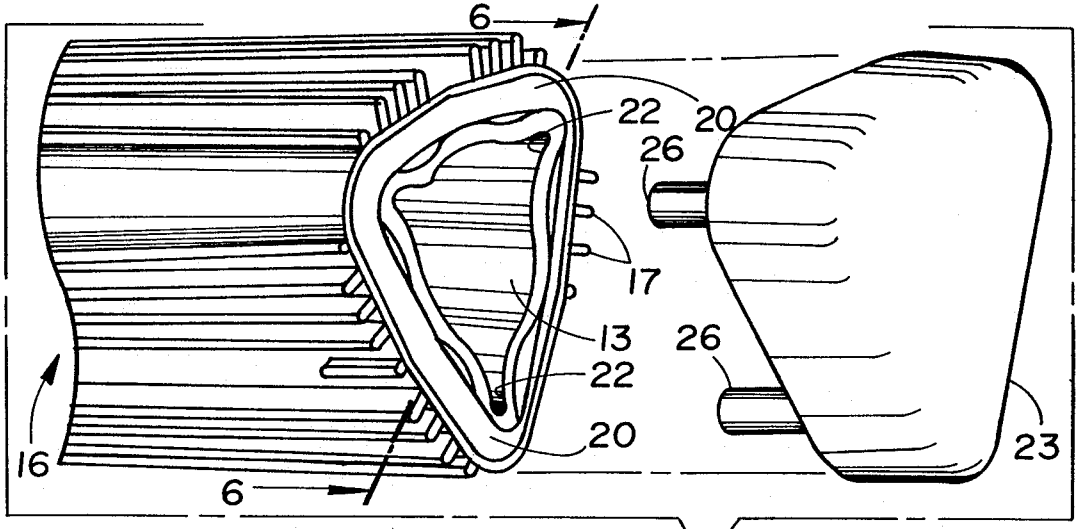
FIG. 5 is a partially exploded view, in perspective, of the hand tool having the handle of the present invention, wherein the end cap is removed therefrom to show its arrangement therewith.

The sleeve 16 has an end face 20 which, preferably, is coterminous (axially) with the rearward end of the handle 10, as is most clearly shown in FIG. 5. The sleeve 16 further has an outer diameter which is substantially coterminous (radially) with the outer diameter of the forward portion 12 of the sleeve 16. In such a case, it is preferred that the ribs 17 extend beyond this outer diameter, as is perhaps most clearly shown in FIGS. 4 and 6. This arrangement further tends to prevent the handle 10 (and thus the hand tool 1) from rolling when placed on a surface 4. Alternatively, the sleeve 16 may be either reduced or enlarged in diameter (radially), as desired, relative to the sleeve 16. In the former case, the ribs 17 may be either coterminous (radially) with or extend beyond this outer diameter. In the latter case, the ribs 17 will extend beyond this outer diameter of the forward portion 12. However, it is noted that in any case, the sleeve 16 will still be substantially coterminous (radially) therewith.

Figure 6:
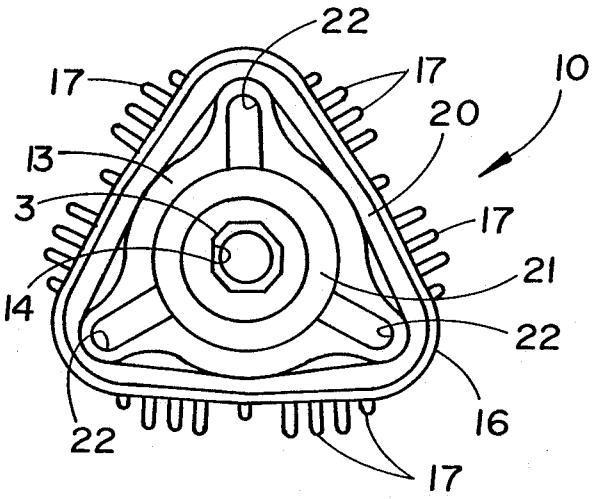
FIG. 6 is an end view taken along lines 6—6 of FIG. 5.

As perhaps best seen in FIGS. 5 and 6, if desired, the rearward portion 13 of the handle 10 (the end opposite to that end which is attached to the shank 3 and/or the tool portion 2) may have a central bore 21 formed therein extending along the common longitudinal axis 11 (substantially opposite to the tool portion 2). If desired, this bore 21 may extend all the way through the handle 10, so as to be in communication with (or to terminate as) the bore 14, which is shaped so as to receive the shank 3 therein. Alternatively, the central bore 21 may be formed as a blind ended bore.

Formed in the rearward portion 13 of the handle 10, substantially opposite from the tool portion 2, are a plurality of pockets 22. Pockets 22 are, preferably, formed as individual blind-ended bores having a curved wall. In the event that a central bore 21 is formed in the handle 10, each of the pockets 22 may be formed so as to be in open communication with the central bore 21. If desired, the ends of the curved walls of the pockets 22 (those ends which are contiguous with and in communication with the central bore 21) may be slightly inwardly flared for reasons that shall be discussed below.

It is desired that each of the pockets 22 be disposed on respective longitudinal axes that are substantially parallel to the common longitudinal axis 11. However, if desired, it is to be understood that the pockets 22 may, alternatively, be formed on respective axes that are either oriented outwardly from and/or inwardly towards the common longitudinal axis 11.

It is further preferred that each of the pockets 22 be substantially equidistantly spaced from and about the common longitudinal axis 11 (and the central bore 21, if provided). It is also preferred that each of the pockets 22 be substantially equidistantly spaced from one another, about the common longitudinal axis 11 (and/or the central bore 21).

Disposed on the rearward portion 13 of the handle 10, opposite to the tool portion 2, is an end cap 23. The end cap 23 is so disposed so that it is received substantially over the pockets 22. Disposed thusly, the end cap 23 may be secured, or keyed, to the handle portion for identification purposes.

Figure 8:
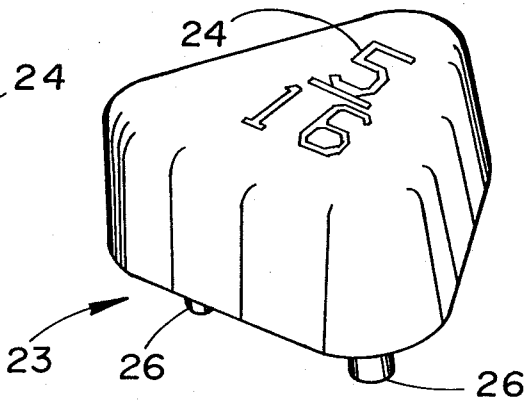
FIG. 8 is a perspective view of an end cap of the present invention wherein the indicia is a label disposed in the recess thereof.
Figure 7:
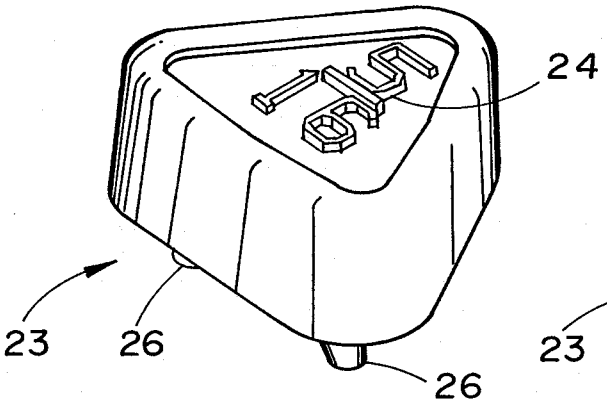
FIG. 7 is a perspective view of an end cap of the handle of the present invention wherein indicia is stamped in the recess thereof.

With particular reference now to FIGS. 7 and 8, the end cap 23 having the indicia means 24 is illustrated.

End cap 23 may, if desired, be color coded to facilitate instant and easy user recognition and selection of a desired hand tool. In doing so, it is contemplated that the end cap 23 will be fabricated from some transparent or substantially transparent material. However, this is not required.

End cap 23 may be provided with a recessed portion (either external or, as shown, internal) 25 wherein the indicia means 24, such as a size indicia, and/or other information, may be disposed (FIG. 8) and/or stamped (FIG. 7) so that it may be easily observed to facilitate user recognition and selection. An example of such indicia means 24 is a pressure sensitive laminated label. Such placement of the indicia (especially placement in an internal recessed portion) 24 protects it from wear and tear and from solvents that may obliterate and/or wear the indicia 24 away. However, it is to be noted that, alternatively, recess 25 may be omitted and that the indicia 24 may be stamped (such as by impression stamping, printing, engraving or other suitable means) or disposed in the cap 23 or on the exterior surface thereof. If a label is disposed on the exterior surface of the cap 23, it is preferred that clear polyester (protective laminate) be provided for the label or that a clear ultraviolet light cured sealant be used which would be impervious to most hydrocarbon and liquid substances utilized in the automotive industry and therefore aid in protecting the label.

The end cap 23 may be any suitable shape and/or size. However, it is contemplated herein that the end cap 23 will be shaped so as to be substantially polygonal in cross-section, being complementary to the shape of the handle 10 and the sleeve 16. In this respect, it is preferred that the end cap 23 be substantially triangular in cross-section and that the end cap 23 be sized so as to be substantially coterminous (radially) with the outer diameter of the sleeve 16 (or with the outer diameter of the handle 10, if so desired) when disposed in place on the handle 10.

The end cap 23 has a plurality of locating studs 26 formed thereon and extending substantially forwardly thereof. In this fashion, when the end cap 23 is disposed on the rearward portion 13 of the handle 10, each of the studs 26 is to be received in a respective pocket 22. In this respect, it is noted that each of the studs is to be shaped, spaced and oriented on respective axes so as to be complementary to the shape, spacing and orientation of the respective pockets 22 in which they are received. Thus, it is contemplated that each of the studs 26 will have a curved wall and a straight wall (so as to be coterminous with the periphery of the central bore 21) if the pockets 22 are in communication with the central bore 21. Also, shaped thusly, if the ends of the curved walls are slightly inwardly oriented or flared (as described above) the studs 26 will tend to be restrained thereby and thus be retained in the pockets 22 from radially sliding or otherwise moving into the central bore 21.

In light of the above, it is noted that in the event that the handle 10, sleeve 16 and end cap 23 are all shaped so as to be substantially triangular in cross-section, then it is preferred that three pockets 22 and three complementary studs 26 be provided, one stud 26 and one pocket 22 being positioned so as to be substantially radially aligned with a respective angle of the polygonal shape. In a similar fashion, if the polygonal shape were a square, then four pockets 22 and four studs 26 would be provided; if the polygonal shape were a pentagon, then five pockets 22 and five studs 26 would be provided and so on.

Finally, means is provided for bonding (securing) the studs 26 to the handle 10 in the respective pockets 22, whereby the end cap 23 is secured to the handle portion 10 substantially opposite the tool portion 2. Any suitable means may be utilized to affect this bonding. However, it is preferred that this means be either ultrasonic bonding or a suitable adhesive, such as glue.

Figure 10:
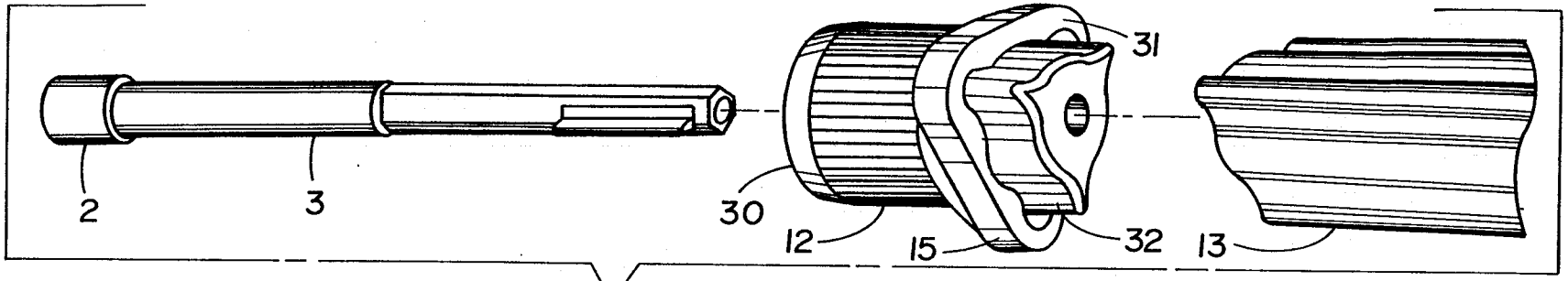
FIGS. 10–12 are perspective views of the handle and the hand tool of the present invention showing, stepwise, the preferred method of construction thereof.
Figure 11:
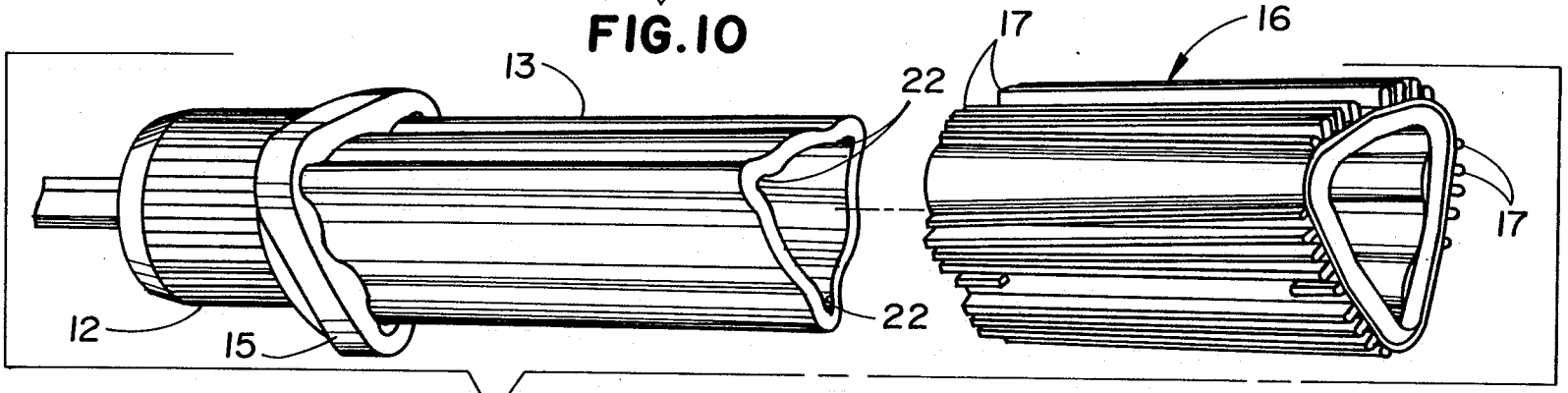
Figure 12:
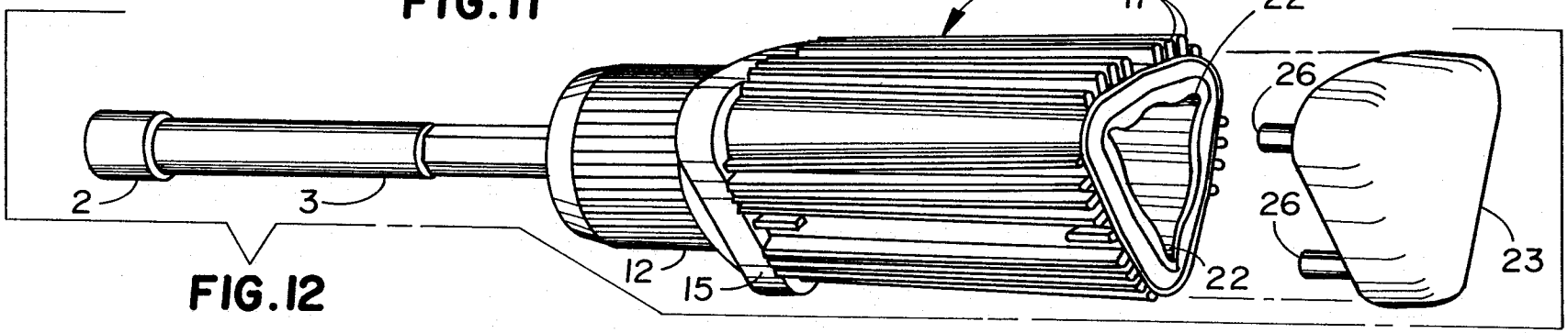
Figure 13:
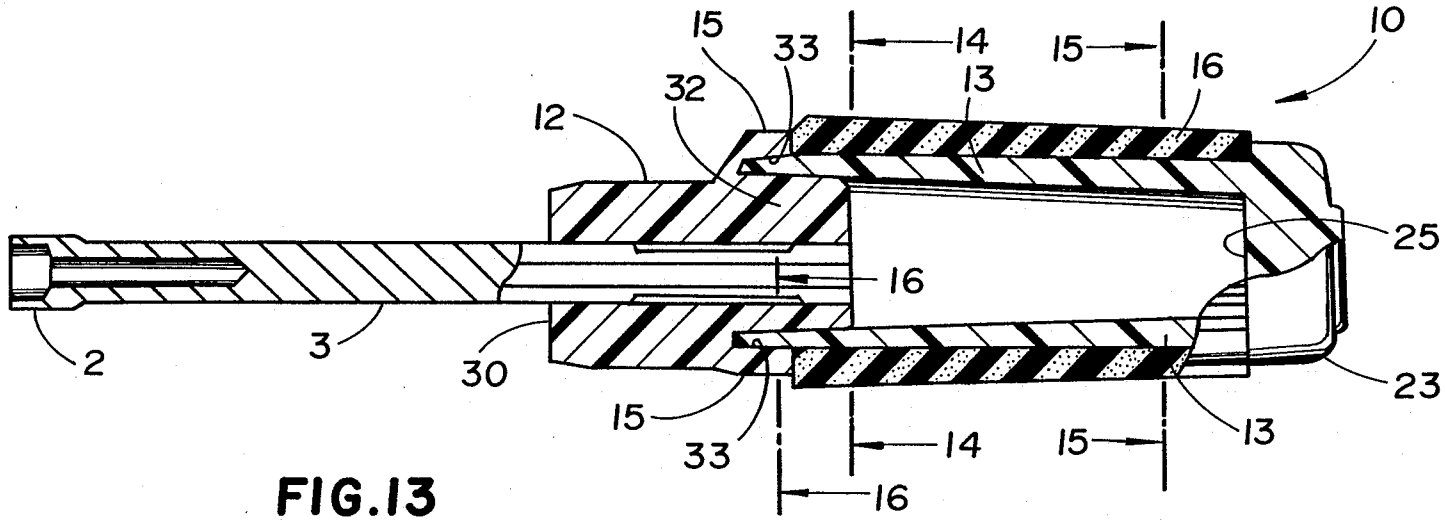
FIG. 13 is a longitudinal cross section of a second embodiment taken along the lines 13—13 of FIG. 1.
Figure 16:
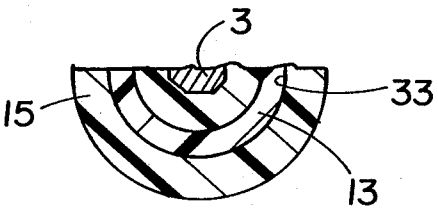
FIG. 16 is a cross section of second embodiment taken along the lines 16—16 of FIG. 13.
Figure 15:
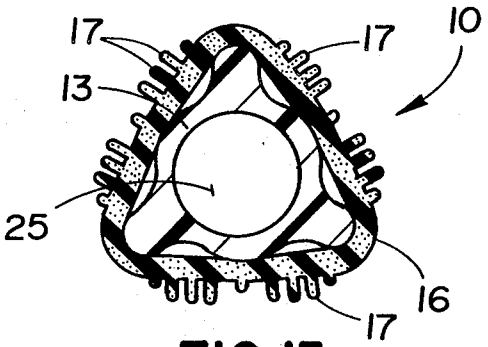
FIG. 15 is a cross section of a second embodiment taken along the lines 15—15 of FIG. 13.
Figure 14:
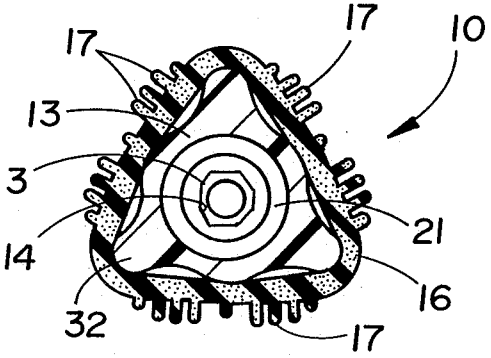
FIG. 14 is a cross section of a second embodiment taken along the lines 14—14 of FIG. 13.

Referring now to FIGS. 10–12 (wherein like numbers are used for similar parts) the preferred method of forming a handle 10 for a hand tool 1 is illustrated.

A handle portion 10 is formed having the forward portion 12, rearward portion 13, bore 14, annular shoulder 15, and pockets 22, as described above. If desired this handle 10 may also be formed having the central bore 21, as was described in detail above with reference to FIGS. 1–9.

Also, an elastomeric material is formed into a sleeve 16, including the ribs 17 and (if desired) indicia 18 and recesses 19, as was also described above.

Finally, an end cap 23, including the studs 26 and (if desired) recess 25, as described in detail above is molded from a suitable material. The indicia means 24 may be simultaneously molded thereon or it may thereafter be stamped or engraved thereon. Alternatively, a laminated label having the indicia printed thereon and having adhesive disposed thereon may be formed and disposed thereon, as was also described in detail above.

The tool portion 2 having the shank 3 is similarly formed.

The formed shank 3 is axially oriented relative to the longitudinal axis 11 and the bore 14 of the handle 10 (FIG. 10). The shank 3 is then slidably disposed in the bore 14 and suitable secured thereto by adhesive or any other suitable means.

The formed sleeve 16 is axially oriented relative to the longitudinal axis and the outer diameter of the handle portion 10 (FIG. 11). This sleeve 16 is then slightly stretched, so that it may be received over the outer diameter of the (rearward portion 13) handle 10. The sleeve 16 is then slidably disposed on the rearward portion 13 of the handle 10 and released so that it can return to its original size. Preferably, this sleeve 16 is located on the handle 10 abutting the shoulder 15 and with the end face thereof substantially coterminous (axially) with the rearward end of the handle 10 (see FIG. 12).

Next, if an adhesive (such as glue) is to be utilized to bond the studs 26 in the respective pockets 22, the adhesive is disposed in each of the pockets 22 by any suitable means, such as by use of an injection nozzle.

With reference to FIG. 12, the end cap 23 is axially oriented relative to the longitudinal axis and the outer diameter sleeve 16. The end cap is then disposed on the rearward portion 13 of the handle 10 opposite the tool portion 2, so that the cap 23 is received substantially over all of the pockets 22 and further so that each of the studs 26 is received in a respective pocket 22.

If ultrasonic bonding is utilized to bond (secure) the end cap 23 to the rearward portion 13 of the handle 10, then this bonding may be effected after the disposition of the studs 26 in the pockets (and the cap 23 on the rearward portion 13 of the handle 10).

In the event that the indicia means 24 utilized is a laminated label, then this label may be disposed in the recess 25 prior to disposition of the end cap 23 on the handle 10 or it may be disposed on the surface of the cap 23 prior to or after disposition of the end cap 23 on the handle, as described above.

In another embodiment as shown in FIGS. 13–16, the end cap 23 is integral with the rearward handle portion 13. The end cap 23 has a polygonal shape complementary to that of the rearward handle portion 13 but constitutes an enlarged shoulder, having dimensions larger than the rearward handle portion 13. In this manner, the elastomeric sleeve 16, which is placed on the handle portion 13 from the forward to the rearward direction, abuts the enlarged end cap so that the sleeve 16 is retained on the rearward handle portion 13. The end cap 23 has indicia means 24 to facilitate user recognition and selection. The rearward portion 13 has a blind ended central bore 21 opposite to the end cap 23.

A forward handle portion 12 (or nose piece) has a forward end 30 and a rearward end 31 with a radially enlarged annular shoulder 15 therebetween. Formed in the annular shoulder in the direction of the rearward end 31 is a trepan 33. A boss 32 extends from the rearward side 31. The boss 32 has a polygonal shape complementary to the central bore 21 in rearward portion 13 and is received therein. The rearward handle portion 13 is received in the trepan 33, further securing the forward handle portion 12 to the rearward handle portion 13. The handle portions may be further secured by adhesive (glue) or ultrasonic sealing. When the forward portion 12 is received by the rearward portion 13 on which the sleeve 16 has been fitted, the sleeve 16 is securely retained between the end cap 23 and the annular shoulder 15. The forward handle portion 12 further has a bore 14 along the longitudinal axis 11.

A preferred method of forming another embodiment of the hand tool 1 is illustrated.

As described immediately above, a forward handle portion 12 is formed having an annular shoulder 15, a boss 32 and a bore 14 along the longitudinal axis 11. A rearward handle portion 13 is formed having a blind central bore 21 and an integral end cap 23 having indicia means 24.

An elastomeric material is formed into a sleeve 16, including ribs 17 and (if desired) indicia 18 and recesses 19 as was described above.

The elastomeric sleeve 16 is disposed over the rearward handle portion 13 and abutting the end cap 23. The boss 32 of the forward handle portion 12 is received in the central bore 21 of the rearward handle portion 13. The sleeve 16 is retained on the handle 10 between the end cap 23 and the annular shoulder 15.

The tool portion 2 having the shank 3 is formed as described above.

The shank 3 is axially oriented relative to the longitudinal axis 11 and the bore 14 of the forward handle portion 12. The shank 3 is slidably disposed into the bore 14 and suitably secured therein.

As can be seen from the foregoing description, the handle 10, and the hand tool 1 on which it is employed, it particularly advantageous in that it is easily and economically manufactured utilizing simple dies and equipment without necessitating an substantial modifications thereto. This handle 10 is readily adaptable for use with presently existing tool portions and shanks which may already be in stock and/or for which casting dies are already in supply.

In the above manner, the handle 10 of the present invention further facilitates manufacture, merchandising and promotion of the tools and entire tool sets equipped therewith, the individual components thereof being able to be readily identified by users thereof due to the unique indicia means and end caps provided.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In combination with a forward tool portion, a rearward handle portion, the combination including a substantially-hollow handle body having a cross-sectional configuration substantially in the form of a triangle having three corners spaced substantially equidistantly of one another, wherein the handle portion has three pockets formed therein substantially opposite the tool portion, an end cap disposed on the handle portion substantially over the pockets, the end cap having three forwardly-projecting equiangularly-spaced studs formed thereon, each stud being received in a respective pocket, means for bonding the studs to the handle portion in the respective pockets, whereby the end cap is secured to the handle portion substantially opposite the tool portion, the end cap further having a forwardly facing shoulder formed thereon and further having a rearward face provided with size indicia thereon, and an elastomeric sleeve carried by the substantially-hollow handle body and axially abutting against the shoulder on the end cap.

2. The combination of claim 1, wherein the means for bonding the three studs in the respective pockets of the handle portion is comprised of an ultrasonic bond.

3. The combination of claim 1, wherein the means for bonding the three studs in the respective pockets of the handle portion is comprised of an adhesive.

4. The combination of claim 1, wherein the end cap is molded from a plastic material and is color coded, and wherein the size indicia on the rearward face of the end cap are integrally molded.

5. The combination of claim 1, wherein the tool portion and the handle portion are positioned on a common longitudinal axis, and wherein the pockets are equidistantly spaced from one another about the longitudinal axis for receiving the respective studs therein.

6. A combination hand tool comprising a forward tool portion and a rearward handle portion, the handle portion having a plurality of pockets formed therein substantially opposite the tool portion, an end cap including an indicia means disposed on the handle portion substantially over the pockets, the end cap having a plurality of studs formed thereon, such that when disposed on the handle portion, each stud is received in a respective pocket, means for bonding the studs to the handle portion in the respective pockets, whereby the end cap is secured to the handle portion substantially opposite the tool portion, wherein the handle portion is polygonally shaped in cross-section, thereby substantially precluding the rolling thereof and further wherein the end cap is polygonally shaped in cross-section complemental to the handle portion, wherein the pockets are formed in the handle portion being spaced from one another, and further wherein the studs are formed on the end cap being spaced from one another complemental to the positioning of the pockets, wherein the tool portion and the handle portion are positioned on a common longitudinal axis and wherein the pockets are equidistantly spaced from one another about the longitudinal axis for receiving the respective studs therein, and further comprising a central bore formed in the handle portion along the longitudinal axis substantially opposite the tool portion and wherein each of the pockets is in communication with the central bore.

7. In a hand tool having a forward tool portion and a rearward handle portion disposed on a common longitudinal axis, a substantially-hollow handle body having a cross-sectional configuration substantially in the form of a triangle having three corners spaced substantially equidistantly of one another, wherein the handle portion has three pockets formed therein as blind ended bores substantially opposite the tool portion, each of said pockets being equidistantly spaced from the longitudinal axis and each of said pockets further being equidistantly spaced from one another, an end cap disposed on the handle portion substantially over the pockets, the end cap having a plurality of forwardly-projecting equiangularly-spaced studs formed thereon, each stud being received in a respective pocket, means for bonding the studs to the handle portion in the respective pockets, whereby the end cap is secured to the handle portion substantially opposite the tool portion, the end cap having a forwardly facing shoulder formed thereon and further having a rearward face provided with size indicia thereon, and an elastomeric sleeve carried by the substantially-hollow handle body and axially abutting against the shoulder on the end cap.

8. A hand tool comprising a forward tool portion and a rearward handle portion, the handle portion being substantially triangular in cross-section for substantially preclusing the rolling thereof, the handle portion having at least three pockets formed therein substantially opposite to the tool portion, each of said pockets being substantially opposite to the tool portion, each of said pockets being substantially equidistantly spaced from one another in the handle portion, an end cap including an indicia means, said end cap being substantially triangular in cross-section complemental to the handle portion, the end cap being disposed on the handle portion substantially over the pockets, the end cap having at least three studs formed thereon being equidistantly spaced from one another, such that when disposed on the handle portion each stud is received in a respective pocket, means for bonding the studs to the handle portion in the respective pockets, whereby the end cap is secured to the handle portion substantially opposite the tool portion, and further including a bore formed in the handle portion substantially opposite the tool portion, and wherein each of the pockets is substantially equidistantly spaced about and in open communication with the bore.

9. In combination with forward tool portion, a rearward handle portion disposed on a common longitudinal axis, the handle portion being substantially triangular shaped in cross-section for substantially precluding the rolling thereof and having a bore formed therein extending along the longitudinal axis substantially opposite to the tool portion, the handle portion having at least three pockets formed therein substantially opposite the tool portion, each of said pockets being substantially equidistantly spaced from one another about the bore and being in open communication therewith, and end cap including an indicia means, said end cap being substantially triangular shaped in cross-section complemental to the shape of the handle portion, the end cap being disposed on the handle portion substantially over the pockets, the end cap having at least three studs formed thereon being equidistantly spaced from one another, such that when disposed on the handle portion each stud is received in a respective pocket, and means for bonding the studs to the handle portion in the respective pockets, whereby the end cap is secured to the handle portion substantially opposite the tool portion.

10. The combination of claim 9, wherein the studs are circumferentially spaced about the end cap.

11. In combination with a forward tool portion a rearward handle portion, the combination including a substantially-hollow handle body having an open forward portion, a nose piece telescoped within the open forward portion of the hollow handle body, the nose piece supporting the forward tool portion of the hand tool, the hollow handle body being substantially polygonally shaped in cross-section, an elastomeric sleeve disposed over the handle body, said sleeve being substantially polygonally shaped in cross-section complemental to the handle body, an end cap carried by the handle body, the end cap having a rearward face provided with size indicia thereon, and the elastomeric sleeve being axially retained between a first rearwardly-facing shoulder on the nose piece and a second forwardly-facing shoulder on the end cap.

12. The combination of claim 11, wherein the end cap has three forwardly-projecting equiangularly-spaced studs received in complementary pockets formed in the handle body.

13. A method of forming a handle portion for a hand tool having a tool portion, comprised of the steps of:

forming a rearward handle portion onto the tool portion; the rearward handle portion including a substantially-hollow handle body having an open forward portion, providing a nose piece carrying the tool portion, and telescoping a rearward portion of the nose piece within the open forward portion of the hollow handle body, forming a plurality of equiangularly-spaced pockets in a rearward portion of the hollow handle body;

forming an end cap including a rearward face having indicia means thereon and further including a plurality of forwardly-projecting studs;

disposing the end cap on the handle body opposite the tool portion, such that the end cap is substantially received within the pockets with each stud being received in a respective pocket;

bonding the studs to the handle portion in the respective pockets, such that the end cap is secured to the handle portion substantially opposite the tool portion;

providing an elastomeric sleeve, and securing the sleeve over the hollow handle body, such that the sleeve is retained axially between spaced-apart shoulders formed on the nose piece and end cap, respectively.

14. The method of claim 13, wherein the studs are ultrasonically bonded in the respective pockets of the handle body.

15. The method of claim 13, wherein the studs are adhesively bonded in the respective pockets of the handle body.

16. The method of claim 13, wherein the handle body has a cross-sectional configuration substantially in the form of a triangle having three respective corners forming the respective pockets in the handle body.

17. A method of forming a rearward handle portion for a hand tool having a tool portion, comprised of the steps of:

forming a rearward handle portion being substantially triangular in cross-section;

disposing the rearward handle portion onto the tool portion along a common longitudinal axis therewith;

forming a bore in the rearward handle portion along the common longitudinal axis and opposite to the tool portion;

forming at least three pockets in the handle portion substantially opposite to the tool portion, such that each of said pockets is substantially equidistantly spaced from one another about the bore, and further such that each of said pockets are in open communication with the bore;

forming an end cap including an indicia means, such that the end cap is substantially triangular shaped in cross-section being substantially complemental to the shape of the handle portion, the end of the cap being formed having at least three studs thereon equidistantly spaced from one another;

disposing the end cap on the handle portion over the pockets, such that each stud is received in a respective pocket; and bonding the studs to the handle portion in the respective pockets, such that the end cap is secured to the handle portion substantially opposite the tool portion.

18. In combination with a forward tool portion, a rearward handle portion comprising a substantially-hollow handle body having a forward open end portion, a nose piece having a rearward end portion at least partially telescoped within the open forward end portion of the handle body, the handle body being substantially polygonally shaped in cross section, an elastomeric sleeve disposed over the handle portion, said sleeve being polygonally shaped in cross section complementary to the handle portion; the handle body further having an end cap opposite the forward tool portion, the end cap having a rearward face provided with size indicia thereon, the nose piece having a first rearwardly-facing shoulder formed thereon, the end cap having a second forwardly-facing shoulder formed thereon, and the elastomeric sleeve being retained axially between the first and second shoulders on the nose piece and end cap, respectively.

19. The combination of claim 18, wherein the end cap is formed integrally with the handle body.

20. The combination of claim 18, wherein the end cap is separate from the handle body and is keyed to the handle body and secured thereto.

21. The combination of claim 18, wherein the nose piece has a rearwardly-facing trepan formed therein to receive the forward portion of the handle body.

22. A method of forming a hand tool having a tool portion, comprised of the steps of:

forming a substantially polygonally shaped rearward handle portion having a first end and a second end, the first end having an integrally formed end cap thereon, the second end having a central bore therein, the end cap including indicia means;

disposing an elastomeric sleeve over the handle portion, so as to abut the end cap, the elastomeric sleeve having a shape complementary to the polygonal shape of the handle portion;

forming a forward handle portion having a forward end and a rearward end with an annular shoulder therebetween, the rearward end further having a boss extending therefrom, the boss having a shape complementary to the central bore in the second end of the rearward handle portion and being received therein such that the elastomeric sleeve is retained over the handle portion between the annular shoulder on the forward handle portion and the end cap on the rearward handle portion, the forward handle portion further having a bore therethrough, the bore communicating with the central bore in the rearward handle portion; and joining a tool portion having a shank into the bore in the forwardly handle portion such that the hand tool extends forwardly and opposite to the handle portions and further such that the tool portion and handle portions are positioned on a common longitudinal axis.

23. A hand tool comprising a nose piece having an axial bore formed therein, a shank received in the bore and projecting forwardly therefrom, means for securing the shank to the nose piece, the nose piece including a radially enlarged shoulder portion having a trepan formed therein, a substantially-hollow handle body having an open forward portion received in the trepan in the nose piece and secured thereto, the nose piece further including a rearwardly-extending portion telescoped at least partially within the forward portion of the hollow handle body, the handle body having a radially enlarged rearward portion and further having an intermediate portion between the forward and rearward portions thereof, an elastomeric sleeve carried by the intermediate portion of the handle body, disposed axially between the radially enlarged rearward portion of the nose piece and the rearward portion of the handle body, and the elastomeric sleeve including a grip means thereon, the grip mean being substantially triangular in cross-sectional configuration, and the rearward portion of the handle body being provided with an end cap for the tool, the end cap having size indicia thereon.

24. The hand tool of claim 23, wherein the end cap is formed separately from the handle body and is keyed and secured thereto.

25. The hand tool of claim 24, wherein the end cap is formed integrally with the hollow handle body.

26. The hand tool of claim 23, wherein the end cap has a rearward end face having the size indicia formed thereon.

27. A hand tool comprising a nose piece having an axial bore formed therein, a shank received in the bore and projecting forwardly therefrom, means for securing the shank to the nose piece, the nose piece including a radially enlarged shoulder portion having a trepan formed therein, a substantially-hollow handle body having an open forward portion received in the trepan in the nose piece and secured thereto, the nose piece further including a rearwardly-extending portion telescoped at least partially within the forward portion of the hollow handle body, the handle body having a radially enlarged rearward portion and further having an intermediate portion between the forward and rearward portions thereof, an elastomeric sleeve carried by the intermediate portion of the handle body, disposed axially between the radially enlarged rearward portion of the nose piece and the rearward portion of the handle body and the elastomeric sleeve including a grip means thereon, the handle being substantially polygonally shaped in cross-section, and the rearward portion of the handle being provided with an end cap having a rearward face with size indicia thereon.

28. A hand tool comprising a handle body having an open forward end and a closed rearward end, the handle body further having a bore formed therein and extending rearwardly of the open forward end of the handle body, a nose piece extending forwardly of the handle body and having a rearward portion received within at least a portion of the bore in the handle body, the nose piece having a substantially annular trepan formed therein radially of the rearward portion of the nose piece, such that the forward end of the handle body is received within the trepan formed in the nose piece, a tool shank carried by the nose piece and extending forwardly therefrom, the nose piece having a first rearwardly-facing radially-extending shoulder formed thereon, the rearward portion of the handle body having a second forwardly-facing radially-extending shoulder formed therein, and a sleeve carried by the handle body, retained axially between the first and second shoulders on the nose piece and handle body, respectively, and forming a hand grip for the tool.

29. The hand tool of claim 28, wherein the handle body is a substantially-hollow molded body, such that the rearward portion of the handle body forms an end cap for the tool, and wherein the end cap has a rearward face having externally-visible size indicia molded thereon.

30. The hand tool of claim 28, wherein the handle body and the elastomeric sleeve carried thereon have a substantially triangular cross-section.

* * * * *